US005189815A

United States Patent [19]

Pozzobon et al.

[11] Patent Number: 5,189,815

[45] Date of Patent: Mar. 2, 1993

[54] SKI BOOT WITH FLEXIBLE METATARSAL, TIBIAL AND CALF PORTIONS

[75] Inventors: Alessandro Pozzobon, Paderno Di Ponzano Veneto; Giancarlo Foscaro, Treviso; Adolfo Pozzebon, Sala D'Istrana, all of Italy

[73] Assignee: Nordica S.p.A., Montebelluna, Italy

[21] Appl. No.: 783,758

[22] Filed: Oct. 28, 1991

[30] Foreign Application Priority Data

Nov. 7, 1990 [IT] Italy ..... 40144 A/90

[51] Int. Cl.[5] ..... A43B 5/04

[52] U.S. Cl. ..... 36/117; 36/120

[58] Field of Search ..... 36/117, 118, 119, 120, 36/121, 50

[56] References Cited

U.S. PATENT DOCUMENTS

| | | | |
|---|---|---|---|
| 3,419,974 | 1/1969 | Lange | 36/120 |
| 3,597,862 | 8/1971 | Vogel | 36/117 |
| 3,718,994 | 3/1973 | Spier | 36/117 |
| 4,179,827 | 12/1979 | Vaccari | 36/119 |
| 4,246,708 | 1/1981 | Gladek | 36/117 |
| 4,856,210 | 8/1989 | Delery | 36/117 |
| 4,920,665 | 5/1990 | Pack et al. | 36/117 |
| 4,974,346 | 12/1990 | Marega et al. | 36/121 |
| 5,003,710 | 4/1991 | Pozzobon | 36/117 |

FOREIGN PATENT DOCUMENTS

| | | | |
|---|---|---|---|
| 0353532 | 2/1990 | European Pat. Off. | 36/117 |
| 2820074 | 11/1979 | Fed. Rep. of Germany | 36/117 |
| 3116839 | 2/1982 | Fed. Rep. of Germany | 36/117 |
| 264893 | 11/1949 | Switzerland | 36/117 |

*Primary Examiner*—Jimmy G. Foster
*Assistant Examiner*—M. Denise Patterson
*Attorney, Agent, or Firm*—Guido Modiano; Albert Josif

[57] ABSTRACT

A ski boot which includes at least one quarter associated with a rigid shell, has one or more soft elements for embracing the upper metatarsal region and/or the tibial region and/or the calf region. The soft elements are associated with the shell and/or with the quarter. One or more strengthening elements, for transmitting the efforts from the leg to the ski, are furthermore associated with the shell and/or with the quarter. The boot thus has regions with different rigidity according to the specific requirements of the athlete.

11 Claims, 4 Drawing Sheets

SKI BOOT WITH FLEXIBLE METATARSAL, TIBIAL AND CALF PORTIONS

BACKGROUND OF THE INVENTION

The present invention relates to a ski boot.

Known ski boots are generally constituted by at least one quarter associated with a shell.

Both the shell and the quarter are usually manufactured by injecting thermoplastic material, and are made highly rigid in order to be able to optimally transmit the efforts of the leg to the ski.

This rigidity, however, entails a reduced fit and comfort for the user.

It is thus known to pivot the quarter to the shell at the lower lateral ends, so as to be able to follow the rotation of the leg with respect to the malleoli during flexing and extension.

Even this solution, however, does not solve the problem completely, since both the foot and the leg interact at rigid elements, thus creating localized pressure regions which create discomfort for the user.

Several devices are known for limiting said discomfort and they substantially comprise plates arranged inside the boot and adapted to distribute the pressure of contact with the tibia or with the calf or with the upper metatarsal region of the foot.

All these solutions, beside the fact that they only partially solve the problem, increase the structural complexity of the boot, because they require several intermediate manufacturing steps for the assembly, thus increasing the overall costs of said boot.

As a partial solution to this disadvantage, an Italian Patent Application No. 23756 A/80 of Jul. 28, 1980 by this same Applicant, discloses an upper quarter structure, particularly for ski boots, the peculiarity whereof consists in that it comprises at least one band or stripe member which can be superimposed on the shell at the front upper region of the foot and is fixed to the shell at one end.

An upper quarter portion is furthermore provided which is partially superimposed on said stripe member and embraces the shell at the leg articulation region, said upper quarter portion being, at one end, fixed to the shell at the region of superimposition on the stripe member.

Closure levers are furthermore provided which act on the stripe member and on the upper quarter portion which is arranged at the end opposite to the shell fixing end of said at least one stripe member.

Although this solution is undoubtedly valid, it only partially solves the double problem of having a rigid structure for the optimum transmission of the efforts to the ski and at the same time a soft structure in order to improve the fit for the athlete: although a better articulation of the upper quarter is allowed, said upper quarter in fact still interacts directly with the regions of the tibia and of the leg's calf and, together with the shell, with the instep and upper metatarsal region of the foot.

Also as a partial solution to said disadvantage, the published European Patent Application No. 0 353 532 by this same Applicant, discloses a shell structure particularly for front-entry ski boots, the peculiarity whereof consists in that it has at least one transverse slot, defined at the foot's upper metatarsal region, which can be concealed by means of at least one stripe member which supports means for closing on the shell.

Said slot furthermore affects at least the inner lateral region of the shell.

Even this solution, however, does not solve the above described problems completely.

SUMMARY OF THE INVENTION

The aim of the present invention is therefore to eliminate the disadvantages described above in known types by providing a ski boot which at the same time allows to optimally transmit the efforts from the leg to the ski and allows the skier to achieve an optimum fit and comfort which allows an optimum sports practice.

Within the scope of the above aim, another important object is to provide a ski boot which is structurally composed of a limited number of components which allow an easy industrialization and therefore modest manufacturing time and costs.

Another important object is to provide a ski boot which allows to achieve an optimum fit in the absence of specific elements such as spoilers or plates located in one or more parts thereof.

Another important object is to provide a ski boot which allows to optimally embrace the foot and the leg of the skier without creating localized pressure points.

Another object is to provide a ski boot wherein the foot can be easily inserted.

Not least object is to provide a ski boot which is reliable and safe in use.

This aim, these objects and others which will become apparent hereinafter are achieved by a ski boot comprising at least one quarter associated with a rigid shell and having an upper metatarsal region, a tibial region and a calf region, characterized in that at least one soft element, for embracing at least one of said regions, and at least one strengthening element, for transmitting the efforts from the leg to the ski, are associated with one of either said shell and said at least one quarter, said at least one soft element having at least one seat for securing means.

BRIEF DESCRIPTION OF THE DRAWINGS

Further characteristics and advantages of the invention will become apparent from the detailed description of two particular but not exclusive embodiments, illustrated only by way of non-limitative example in the accompanying drawings, wherein.

DESCRIPTION OF THE PREFERRED EMBODIMENTS

Figure 1:
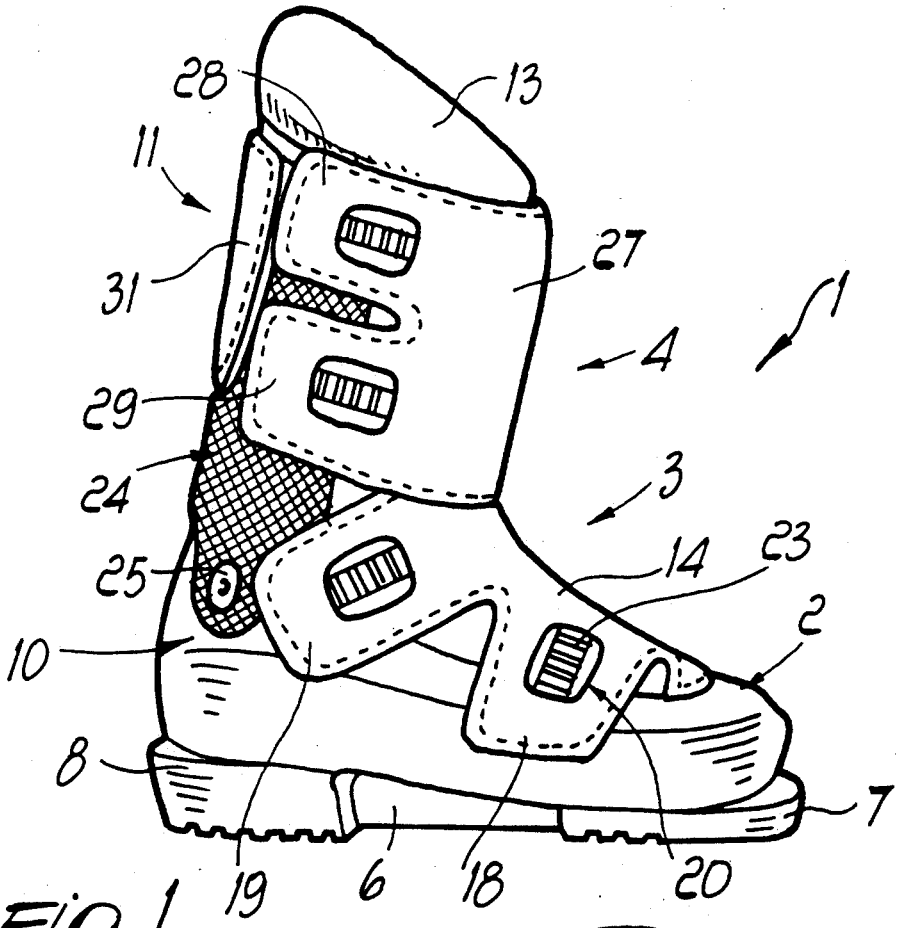
FIG. 1 is a side view of the boot.
Figure 2:
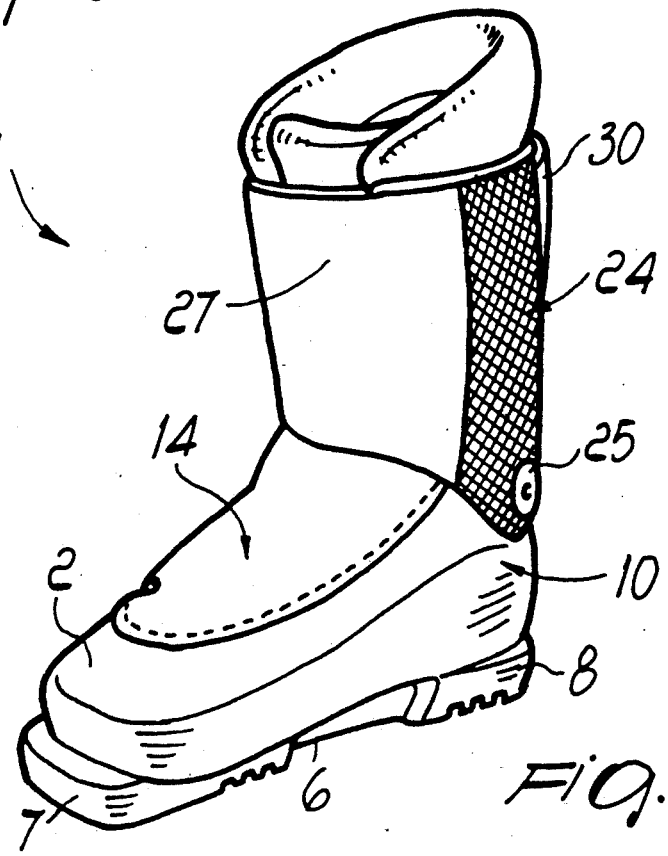
FIG. 2 is a second side perspective view of the boot.
Figure 4:
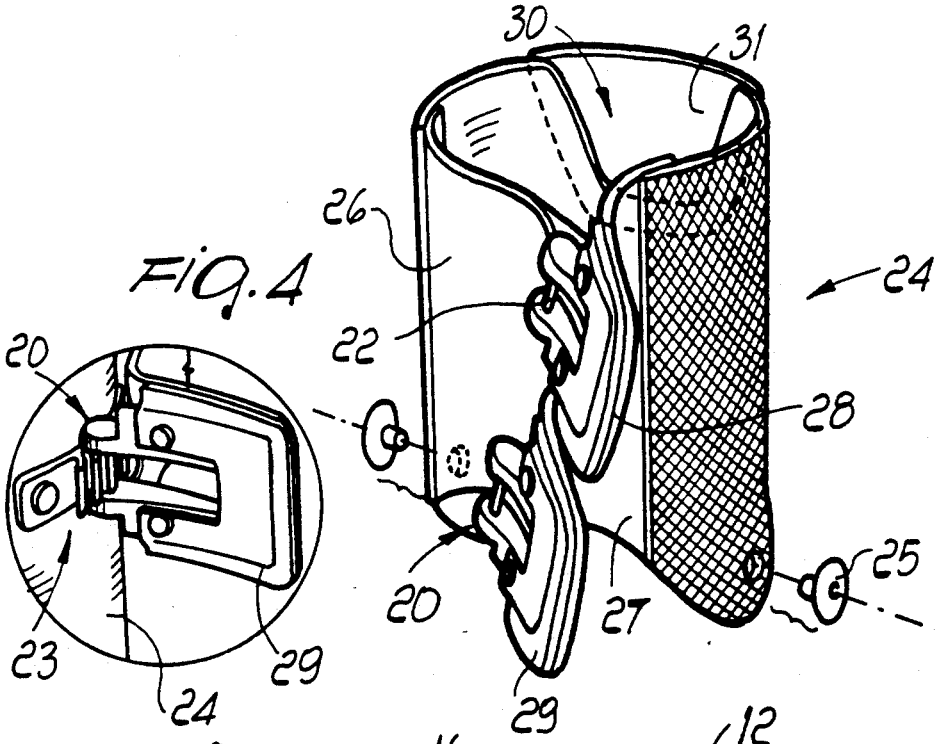
FIG. 4 is a detail view of the lever arm.
Figure 3:
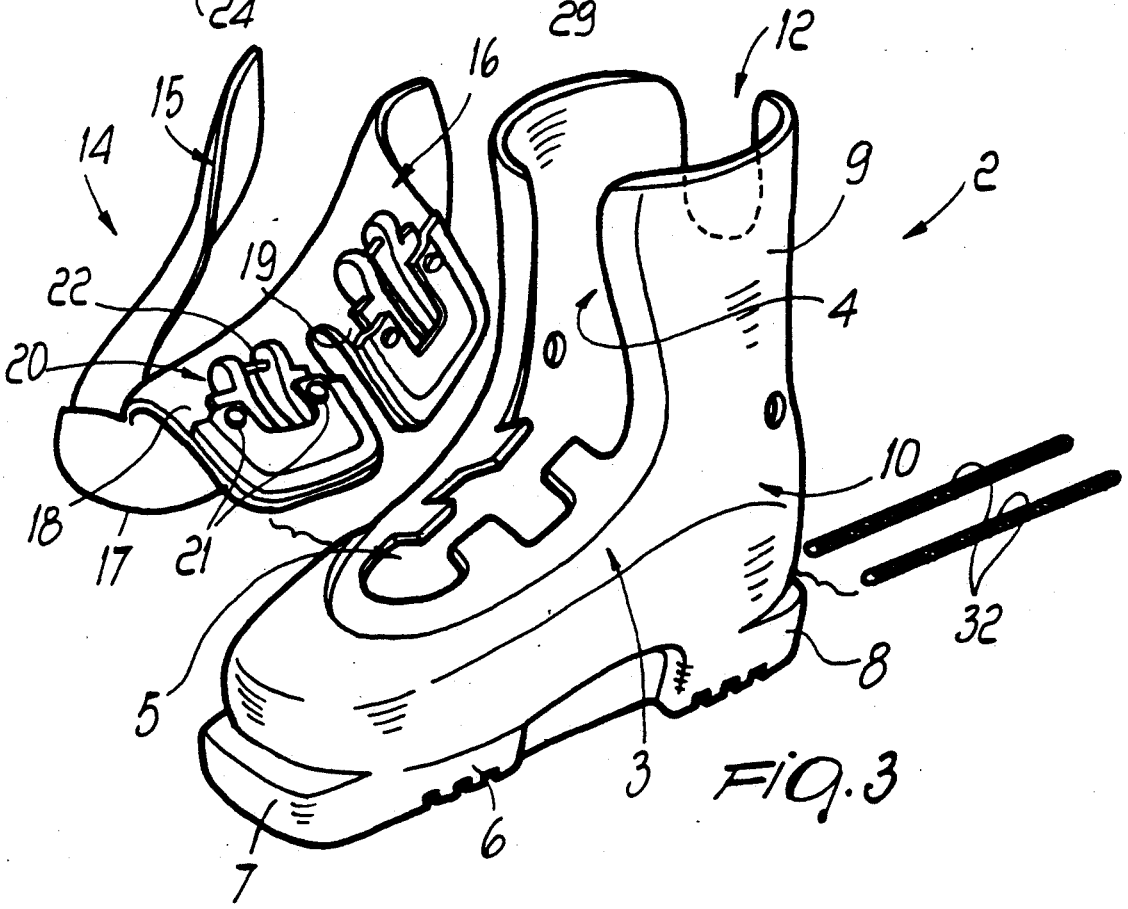
FIG. 3 is an exploded view of the components illustrated in the preceding figures.

With reference to the above figures, the reference numeral 1 indicates a ski boot which is composed of a rigid shell 2 which has a longitudinal opening 5 at the foot's upper metatarsal region 3 and at the tibial region 4.

Said shell furthermore has a sole 6 which has, at the front and at the back, respectively a standardized toe unit 7 and a standardized heel 8; said shell also has an upper quarter 9 which protrudes and extends from the sole above the region 10 of the malleoli and thus embraces the leg of the skier laterally and rearward above the heel.

Conveniently, a recess 12 is defined at the calf region 11 and at least partially affects its longitudinal extension.

The insertion of an adapted innerboot 13 is naturally provided for inside the shell 2.

The rigid shell 2 is preferably manufactured by injecting plastic material.

A first soft or flexible element is associated with the shell 2 at the opening 5 and is constituted by a stripe or band member 14 which is advantageously provided with a first flap 15 and a with second flap 16 which can overlap one another approximately at the longitudinal median axis of the opening 5.

Said band member 14 is for example made of leather or of a similar material, possibly even a synthetic one, which have softness characteristics.

The perimetric edge 17 of said band member is associable, by sewing or by means of another known system, at the region of the shell 2 which is adjacent to the opening 5, so as to conceal said opening and thus arrange itself at the foot's upper metatarsal region 3 and at the region 4 of the lower part of the tibia.

Advantageously, a first tab 18 and a second tab 19 protrude from the second flap 16, and an adapted inner seat for lever arms 20 is defined at the end of said tabs; said lever arms are connected to said first tab and to said second tab for example by means of adapted rivets 21.

Said lever arms 20 are substantially U-shaped and have wings which protrude outside said seat defined on the first and second tabs; a pivot 22 is arranged between said wings and interacts with adapted racks 23 which are associated either at the first flap 15 or at the shell 2.

The band member 14 therefore allows an optimum embracing of the metatarsal region and of the tibia, ensuring, by virtue of the presence of the lever arms 20, an optimum securing of said foot.

A quarter 24 furthermore constitutes the ski boot 1 and is articulated by means of adapted studs 25 laterally to the upper quarter 9.

Said quarter 24 is preferably made of composite material and is thus very rigid and embraces the upper quarter 9 both laterally and rearward.

Second soft elements, constituted by a third flap 26 and by a fourth flap 27 which are for example made of leather, are associable in the region in front of the quarter 24 so as to cover the tibial region 4.

Said third and fourth flaps, which can be mutually superimposed, thus allow to have a soft support for the tibia at the tibial region 4 as well.

Conveniently, a third tab 28 and a fourth tab 29 protrude at the fourth flap 27, and adapted lever arms 20 are associated with the ends of said tabs in adapted seats defined similarly to what is described for the second flap 16; the pivots 22 of said lever arms 20 are associable with adapted racks 23 which are associated either with the quarter 24 or with the third flap 26.

Advantageously, the quarter 24 has, at the rear region and in particular at the recess 12 defined on the upper quarter 9, an opening 30 which is identically shaped.

A third soft element, constituted by an insert 31 which is also preferably made of leather, is associable at said opening 30.

The ski boot 1 has further strengthening elements, constituted for example by a pair of bars 32 which can be inserted at the sole 6 and are preferably made of composite material, thus being suitable for compensating the weakening of the shell 2 due to the presence of the opening 5 defined on the metatarsal region 3 and the tibial region 4.

Figure 7:
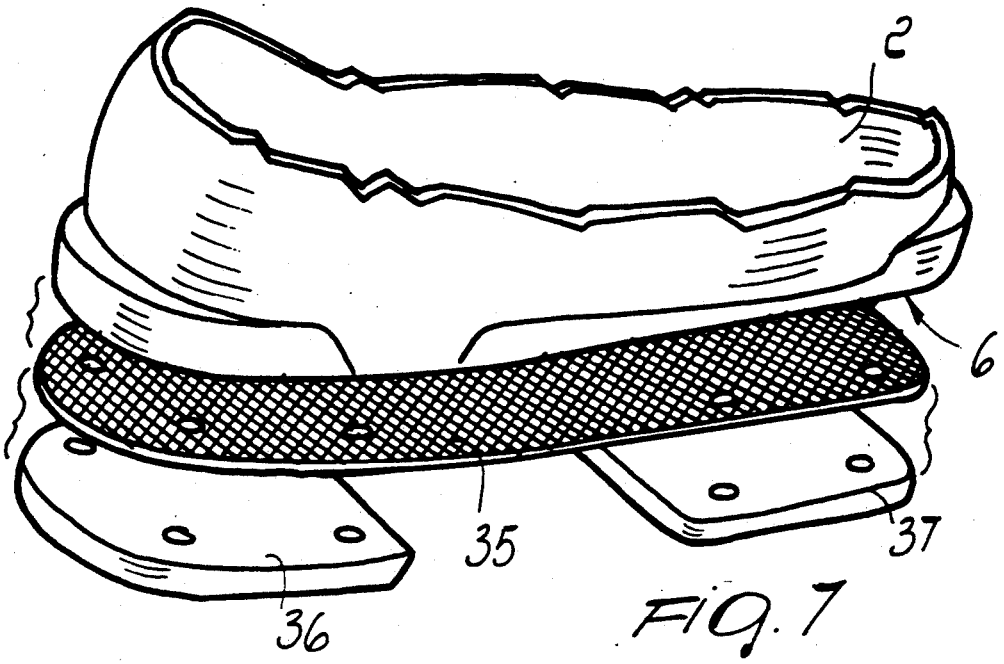
FIG. 7 is a partially sectional side perspective view of the sole of the ski boot according to still a further aspect of the invention.

Alternatively, as illustrated in FIG. 7, said strengthening elements can be constituted by a plate 35 which can be interposed between the sole 6 of the shell 2, the heel 36 and the tip 37 of the boot.

Said heel and said tip, which are manufactured in elements which are separate from the sole, are associated with said sole by known means, retaining the plate 35.

It has thus been observed that the invention has achieved the intended aim and objects, a ski boot having been provided which, by having regions with different rigidity, allows to achieve both an optimum fit for the foot and an optimum transmission of the efforts from the leg to the ski.

Therefore, the presence of the soft elements allows the optimum embracing of the upper metatarsal region, as well as the optimum support of the tibia and of the calf of the athlete's leg, while the strengthening elements allow the optimum lateral hold of the boot and the optimum transmission of the efforts from said boot to the ski.

The use of the soft elements, together with the presence of the lever arms inserted within the tabs provided on said soft elements, allows to achieve optimum securing without creating localized pressure regions which may cause aches to the skier.

The absence of internal devices, for distributing the pressure on the foot and on the leg of the skier, allows to achieve a rapid and simple assembly thereof, thus reducing the manufacturing time.

The ski boot according to the invention is susceptible to numerous modifications and variations, all of which are within the scope of the same inventive concept.

Figure 5:
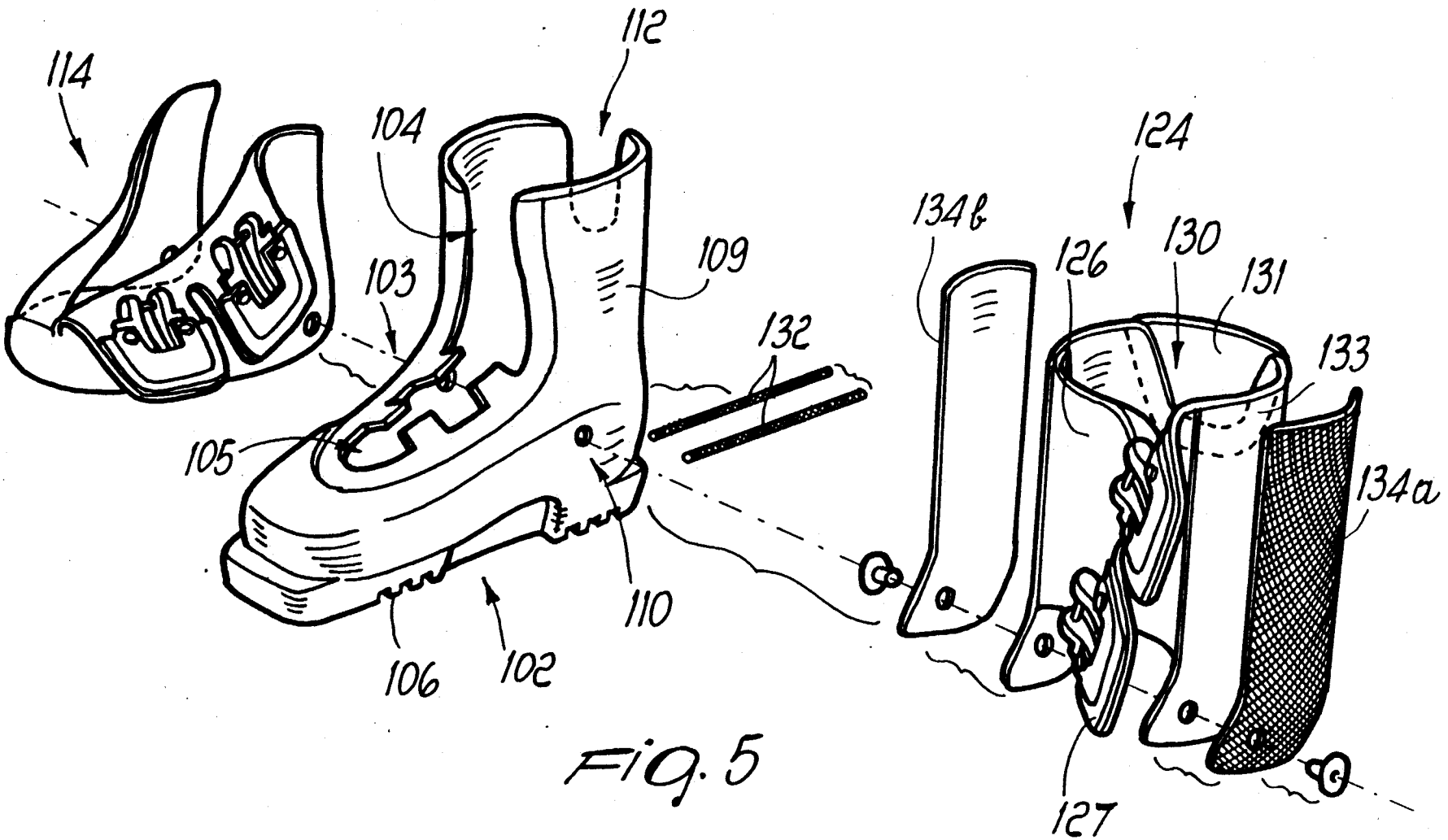
FIG. 5 is an exploded view of the components of a second embodiment for the boot.

Thus, for example, FIG. 5 illustrates a second embodiment wherein the ski boot is again composed of a rigid shell 102 which has, at the upper metatarsal region 103 and at the tibial region 104, a longitudinal opening 105 at which a first soft element, constituted by a band member 114 of the previously described type, is associated.

In this case also, the shell 102 has an upper quarter 109 at the rear region of which the recess 112 is defined.

Strengthening elements, such as bars 132, are similarly associable at the sole 106.

Differently from the previously described embodiment, the quarter 124 is constituted by a body 133 which embraces, laterally and rearward, the skier's leg, and is made for example of the same material which constitutes the shell 102.

It is still possible to associate the insert 131, at the opening 130 defined in the rear region of the calf, and the third and fourth flaps 126 and 127, made of soft material, with said body 133.

In order to allow the optimum transmission of the lateral efforts of the boot, strengthening elements are associable at least laterally with the body 133 of the quarter 124; said strengthening elements are advantageously constituted by a pair of plates 134*a* and 134*b* which are associable with, and shaped complementarily to, the lateral regions of the body 133.

Conveniently, the body 133 which constitutes the quarter 124 is articulated to the shell 102 at the malleolar region 110 together with the pair of plates 134*a* and 134*b*.

Said plates are preferably made of composite material.

Figure 6:
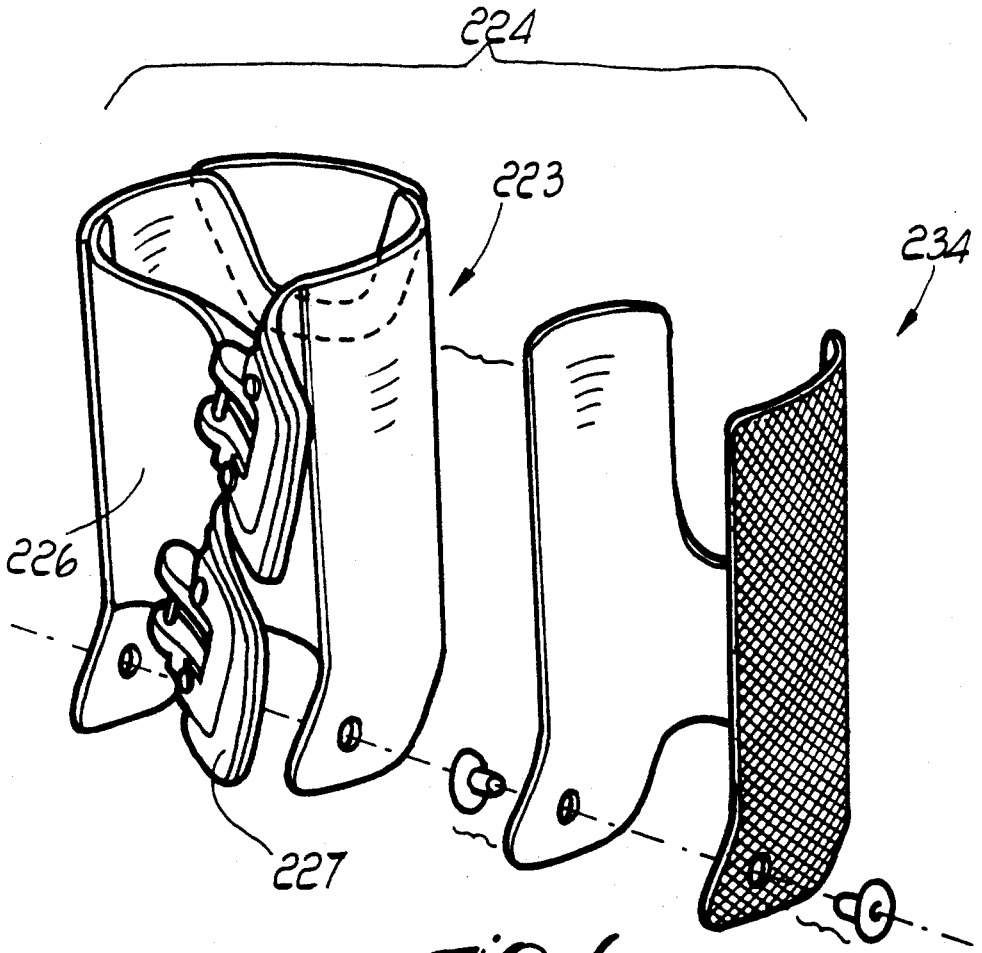
FIG. 6 is a partial view of the quarter according to a further aspect of the invention.

FIG. 6 illustrates a different solution, wherein the quarter 224 is again composed of a body 233 which embraces the skier's leg rearward and laterally and with which a third flap 226 and a fourth flap 227, made of soft material, are associated.

A strengthening element 234 is associable with the body 233 and embraces said body laterally and rearward.

The materials and the dimensions which constitute the individual components of the ski boot may naturally be the most appropriate according to the specific requirements.

We claim:

1. A ski boot comprising a rigid shell having a rigid sole and rigid toe and heel portions, said shell further having a pair of opposite rigid lateral malleoli portions extending upwardly from said sole and past a user's ankle region, and a rigid rear portion extending upwardly from said heel portion, a longitudinal opening being provided in said rigid shell, said longitudinal opening extending from said toe portion past a user's upper metatarsal region and tibial region, a rear recess also being provided in said rigid shell above said rigid rear portion and at a user's calf region, the ski boot further comprising a flexible band member being connected to said shell and covering said longitudinal opening at said metatarsal region, said flexible band member comprising at least one first flexible flap element arranged at said longitudinal opening and being releasably closable for closing said longitudinal opening at said metatarsal region, the ski boot further comprising a quarter which is connected to said shell and which extends around and overlies said lateral malleoli portions, said rear portion, and said longitudinal opening at said tibial region, said quarter comprising at least one second flexible flap element arranged at said longitudinal opening and being releasably closable for closing said longitudinal opening at said tibial region, said quarter being provided with an opening overlying said rear recess of said shell, said quarter further comprising a flexible insert being connected to said quarter and covering said opening thereof, the ski boot further comprising means for releasably closing said at least one first flap element at said metatarsal region, and means for releasably closing said at least one second flap element at said tibial region.

2. The ski boot of claim 1, wherein said quarter comprises rigid portions overlying said lateral malleoli portions and said rear portion of said rigid shell.

3. The ski boot of claim 1, wherein a pair of strengthening plates are connected to said quarter at said lateral malleoli portions of said rigid shell.

4. The ski boot of claim 1, wherein a strengthening element is connected to said quarter, said strengthening element extending at said lateral malleoli portions and said rear portion of said rigid shell.

5. The ski boot of claim 1, wherein said means for releasably closing said at least one first flap and said means for releasably closing said at least one second flap comprise U-shaped lever arms accommodated in seats provided in said at least one first and second flaps, said U-shaped lever arms having wings protruding from said seats and supporting pivots which are selectively and releasably accommodated in rack elements rigidly connected respectively to said shell and to said quarter.

6. The ski boot of claim 1, further comprising means for reinforcing said sole of said shell.

7. The ski boot of claim 6, wherein said means for reinforcing said sole of said shell comprise rigid bars which are inserted in said sole.

8. The ski boot of claim 6, wherein said means for reinforcing said sole of said shell comprise a rigid plate interposed between said sole and underlying toe and heel elements.

9. The ski boot of claim 1, wherein said quarter is pivotally connected to said shell by means of pivot studs.

10. The ski boot of claim 1, further comprising a soft inner boot arranged inside said rigid shell.

11. A ski boot comprising a rigid shell having a rigid sole and rigid toe and heel portions, said shell further having a pair of opposite rigid lateral malleoli portions extending upwardly from said sole and past a user's ankle region, and a rigid rear portion extending upwardly from said heel portion, a longitudinal opening being provided in said rigid shell, said longitudinal opening extending from said toe portion past a user's upper metatarsal region and tibial region, a rear recess also being provided in said rigid shell above said rigid rear portion and at a user's calf region, the ski boot further comprising a flexible band member being connected to said shell and covering said longitudinal opening at said metatarsal region, said flexible band member comprising a first flap element and a second flap element arranged at opposite sides of said longitudinal opening and being releasably closable for closing said longitudinal opening at said metatarsal region, the ski boot further comprising a quarter which is connected to said shell and which extends around and overlies said lateral malleoli portions, said rear portion, and said longitudinal opening at said tibial region, said quarter comprising a flexible third flap element and a flexible fourth flap element arranged at opposite sides of said longitudinal opening and being releasably closable for closing said longitudinal opening at said tibial region, said quarter being provided with an opening overlying said rear recess of said shell, said quarter further comprising a flexible insert being connected to said quarter and covering said opening thereof, the ski boot further comprising means for releasably securing together said first and second flaps and means for releasably securing together said third and fourth flaps.

* * * * *